United States Patent [19]

Moller et al.

[11] 4,195,217

[45] Mar. 25, 1980

[54] HAIR DRYER

[75] Inventors: Heinrich Möller, Kelkheim; Karl-Heinz Hoffmann, Wehrheim, both of Fed. Rep. of Germany

[73] Assignee: Braun Aktiengesellschaft, Frankfurt am Main, Fed. Rep. of Germany

[21] Appl. No.: 878,071

[22] Filed: Feb. 15, 1978

[30] Foreign Application Priority Data

Feb. 28, 1977 [DE] Fed. Rep. of Germany ..... 2708581

[51] Int. Cl.[2] ..... H05B 1/00; A45D 20/08

[52] U.S. Cl. ..... 219/370; 34/97

[58] Field of Search ..... 219/366, 369, 370–371, 219/374, 378–380; 34/96–98, 243 R

[56] References Cited

U.S. PATENT DOCUMENTS

| | | | |
|---|---|---|---|
| 2,478,559 | 8/1949 | Bergeron | 219/369 |
| 3,261,107 | 7/1966 | Ponczek et al. | 219/370 |
| 3,304,625 | 2/1967 | Gesmar et al. | 219/370 |
| 3,383,700 | 5/1968 | Taylor | 219/370 |
| 3,857,016 | 12/1974 | Meyer etal. | 219/370 |

FOREIGN PATENT DOCUMENTS

| | | |
|---|---|---|
| 2409019 | 8/1974 | Fed. Rep. of Germany . |
| 568733 | 11/1975 | Switzerland . |

OTHER PUBLICATIONS

Schick to Show Slim Styling Stick, Home Furnishings Daily, 8/7/76.

*Primary Examiner*—Gerald P. Tolin
*Assistant Examiner*—Bernard Roskoski
*Attorney, Agent, or Firm*—Fishman and Van Kirk

[57] ABSTRACT

A hair dryer comprising a generally tubular housing including twogenerally semi-cylindrical grip parts having edges including complimentary grooves and projections which engage each other to secure the grip parts together, the housing accommodating a heating device, a motor and an air transport device therein, a first end grid which is mounted over an intake opening on one end of the housing to secure the grip parts to the first grid as well as to each other, and a second end grid mounted over an exhaust opening at the other end of the housing to secure the semi-cylindrical grip parts to the second grid as well as to each other.

10 Claims, 15 Drawing Figures

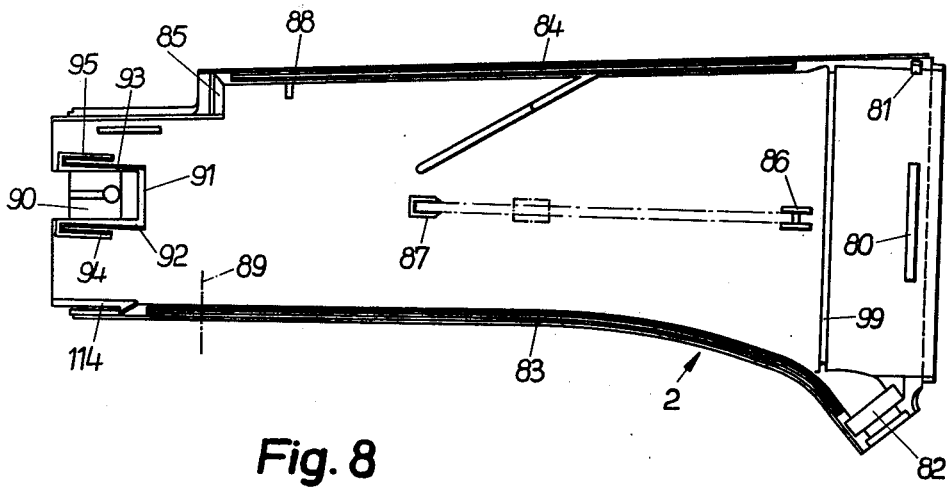
Fig. 8
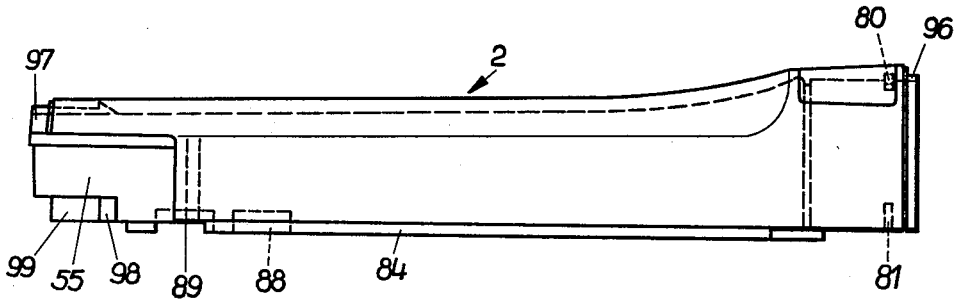
Fig. 9
Fig. 10
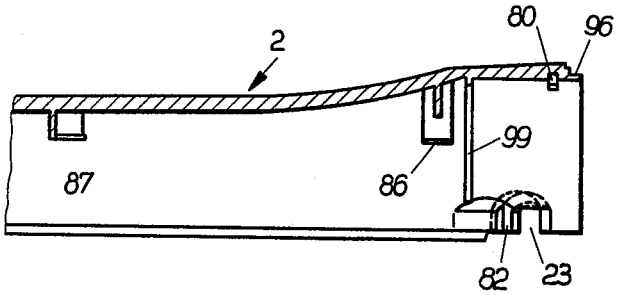

HAIR DRYER

BACKGROUND OF THE INVENTION (1) Field of the Invention

The present invention relates to compact, hand held hair dryers.

(2) Description of the Prior Art

For drying wet hair, electrical devices are used which intake cool air, heat the air and exhaust the air from the dryer to dry hair. There is a growing interest in hair dryers which are for use in the home. The hair dryer should be compact in order to have utility not only in hairdressers' salons, but also, in homes.

Various types of compact, manually operated hair dryers are known. The best known ones are fitted either with a radial or with a tangential air fan or blower (see German Offenlegungsschrift No. 26 18 816 or German Offenlegungsschrift No. 2 307 992). Neither of these types of air blowers are, however, suitable for constructing hair dryers in a rod-shaped or tubular form.

For portable hair drying hoods a rod-shaped heater-blower unit has already been proposed. One end of such a unit can be connected to the hood (German Offenlegungsschrift No. 1 902 662). This heater-blower unit consists of a motor, a plurality of heater coils and an air blower. These elements of the unit are arranged successively along the axis of the blower. Here the air is intaked by a blower which is disposed at the lower end of the hair dryer and which is remote from the drying hood. The air is conveyed over the motor and the heater coils. However, this heater-blower unit may only be used in conjunction with a drying hood.

Furthermore, there exists a hair care accessory for domestic hair dryers that has a tubular element. One end of this is constructed so that it can be connected by a quick-release coupling to the outlet of the hose of the hair dryer (U.S. Pat. No. 3,322,144). The other end of this tubular element can also be releasably connected to hair-curlers having various sizes. However, this hair care accessory cannot be used as a separate hand-held hair dryer.

An approximately rod-shaped manual hair dryer that can be used without additional accessories is disclosed in U.S. Pat. No. 4,039,774. This hair dryer is designed so that all of its essential parts, that is, the motor, fan and the heater unit are arranged so as to be spaced from the grip part, whereby a user cannot feel any significant heat on the grip during operation. This construction can only achieve an approximately tubular shape due to the grouping together of the motor, fan and heater unit. The housing at the end which accommodates these parts is substantially larger than the other end of the housing.

In addition, there is a known hand-held hair dryer which has a tubular housing (German Offenlegungsscrift No. 24 09 019). However, in this hair dryer, the intake opening and the exhaust opening are perpendicular to the longitudinal axis of the dryer.

Finally, there is a known air-heating apparatus for hair treatment which includes a tubular housing containing a motor, a fan and screw-shaped heating coils (Swiss Patentschrift No. 568 733). The manufacturing costs of this air appliance are, however, relatively high.

An object of the invention is to provide a hair dryer which enables drying of the hair to be carried out comfortably, which can be used as an accessory for drying hoods and which can be assembled easily.

It is another object of the present invention to provide a hair dryer which is compact and which has a tubular shape.

SUMMARY OF THE INVENTION

The present invention provides a hair dryer comprising a generally tubular housing including two generally semi-cylindrican grip parts having edges including complimentary grooves and projections which engage each other to secure the grip parts together. The tubular housing accommodates a heating device, a motor and an air transport device therein and defines an intake opening at one end and an exhaust opening at the other end. A first end grid which is mounted over the intake opening secures the grip parts to the first end grid as well as to each other. A second end grid which is mounted over the exhaust opening secures the grip parts to the second grid as well as to each other.

The hair dryer provided is compact and has a generally tubular shape. The hair dryer is easy to assemble in that the heating device, the motor and the air transport device may be fitted into one semi-cylindrical grip part. The other grip part is then engaged with the first grip part to provide a tubular housing. The end grids are then placed over the intake and exhaust openings and secure the grip parts together without requiring the use of screws or other bulky attachment means.

DETAILED DESCRIPTION OF THE DRAWINGS

FIG. 8 shows in elevation the second semi-cylindrical grip part;

FIG. 9 shows the second semi-cylindrical grip part according to FIG. 8 rotated 90 degrees;

FIG. 10 shows a fragmentary section taken along the central axis of the grip part of FIG. 8;

DETAILED DESCRIPTION OF THE INVENTION

Figure 1:
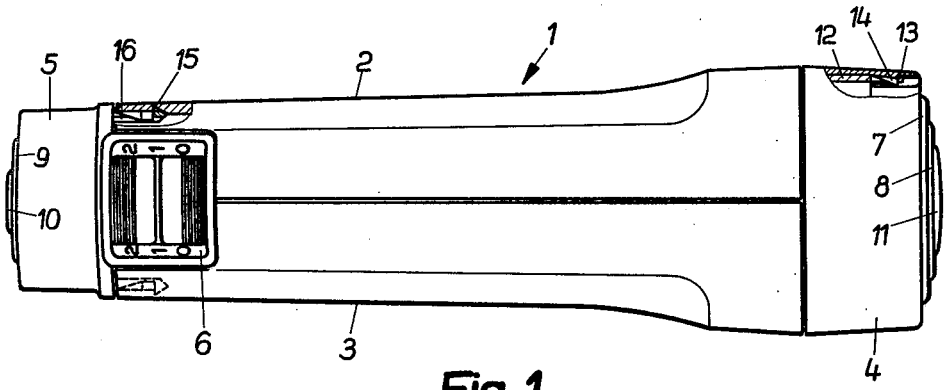
FIG. 1 is a plan view of a hair dryer according to the invention.

In FIG. 1, hair dryer 1 has an outer envelope or housing which comprises the following components: semi-cylindrical grip parts 2 and 3, suction grid 4 through which cool air is allowed to flow into the interior of hair dryer 1 and an exhaust grid 5 through which air heated by hair dryer 1 is allowed to flow from the interior of hair dryer 1. In front of exhaust grid 5, three-way slider switch 6 is fitted and provides for the control of hair dryer 1. Suction grid 4 and exhaust grid 5 include respectively air passage ribs 7, 8 and 9, 10. Suction grid 4 is shown in FIG. 1 in partly broken-away illustration so that the securement means for securing suction grid 4 to grip part 2 is shown. The periphery of suction grid 4 is pushed over the perimeter of air swirler 12 which is fitted with barb 13 which engages web 14. Web 14 is located on the interior of suction grid 4. Exhaust grid 5 is also shown partially broken-away and, as can be seen grip part 2 includes notch 15 in which barb 16 of exhaust grid 5 engages.

Figure 2:
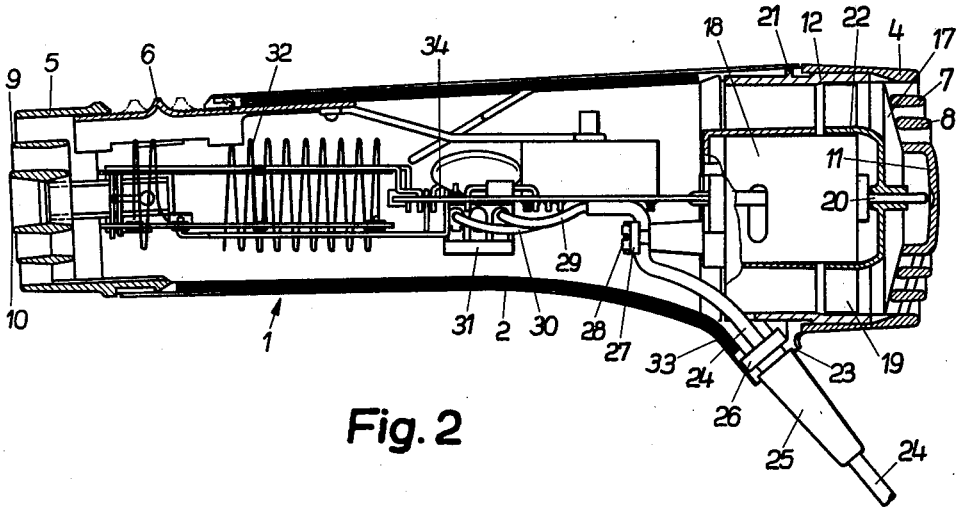
FIG. 2 is a cut-away side view of the hair dryer.

Referring to FIG. 2, mesh 17 is located adjacent to and behind air passage ribs 7 and 8 of suction grid 4 and upstream of air swirler 12. Air swirler 12 drives the air impeller or fan wheel 19 via shaft 20 and rim 22. Air swirler 12 is fitted into the grip part 2 by way of web 21 positioned on the exterior of air swirler 12.

To provide electricity to hair dryer 1, grip parts 2 and 3 are provided with aperture 23 through which electric supply cable 24 is introduced. Supply cable 24 is sheathed by frustoconical sleeve 25 that includes collar 26 which rests in a groove provided by aperture 23. With the aid of clamp 27 and fixing screw 28, supply cable 24 can be permanently fixed inside hair dryer 1. From supply cable 24, two connecting leads 29 and 30 lead to connection element 31 which is connected to electric wire-heater 32 disposed directly adjacent to exhaust grid 5. Conductor plate 34 that can be rigidly clamped to the grip part 2 serves to lock the inner components of hair dryer 1 in position.

Figure 3:
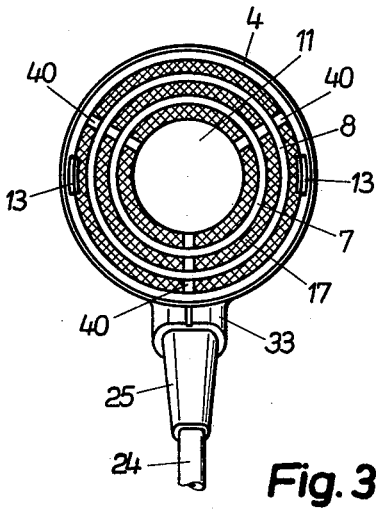
FIG. 3 is a front view of the hair dryer.

FIG. 3 shows hair dryer 1 from the rear. Supply cable 24 with sleeve 25 leads into apertures 23 of pipe 33. Suction grid 4 includes air passage ribs 7 and 8 and central disc 11. Suction grid 4 includes three stiffening ribs 40 and is connected to the swirler 12 (not shown in FIG. 3) by means of barb 13. Directly behind the air passage ribs 7 and 8 and stiffening ribs 40 is the mesh 17.

Figure 4:
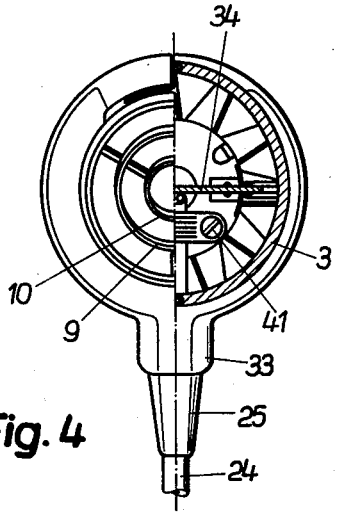
FIG. 4 is a partially broken away rear view of the hair dryer.

The partially broken-away view of FIG. 4 shows the front of hair dryer 1. Supply cable 24, sleeve 25, and pipe 33 as well as the exhaust grid 5 including air passage ribs 9 and 10 are all shown. Fastening member 41 and conductor plate 34 are also shown.

Figure 5:
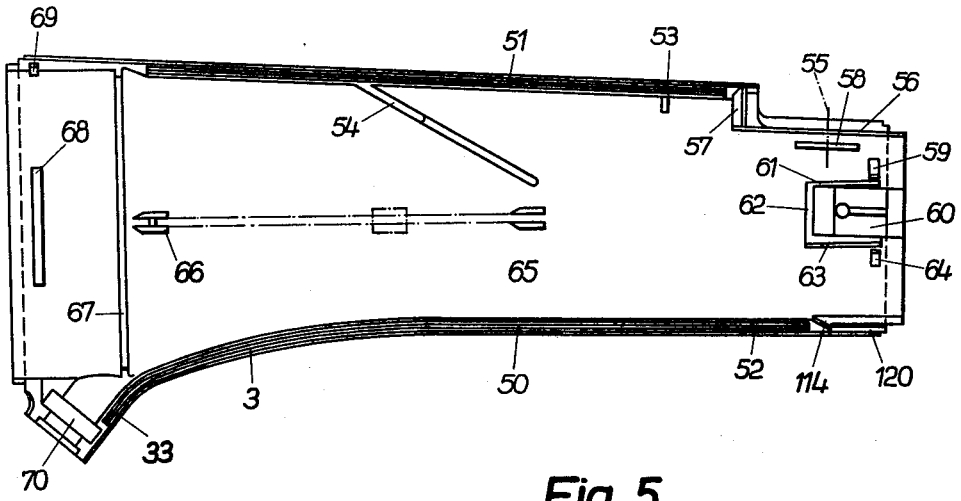
FIG. 5 shows the first of two semi-cylindrical grip parts forming part of the hair dryer in elevation.

FIG. 5 shows in plan view the interior of grip part 3 in detail. The boundary edges of grip part 3 include grooves 50 and 51 and protruding tongues 52 and 53 which run longitudinally and which intermesh with similar grooves and tongues on grip part 2. At about the middle of grip part 3, projection 54 extends from the edge almost to the center line of grip part 3. Spaced closely next to projection 54 is notched projection 65 for accommodating conductor plate 34.

As viewed in FIG. 5, the right-hand end of grip part 3 has recess 55 bordered by horizontal groove 56 and vertical groove 57. Beneath horizontal groove 56 extends projection 58 which is adjacent to protruding projection 59. Recess 60 is machined into the wall of grip part 3 and is bounded by projections 61, 62 and 63. Projection 64 is located about the recess 60 and is symmetrical to projection 59.

For accommodating conductor plate 34, a further notched projection 66 is provided on the left-hand side of grip part 3. Adjacent to projection 66, the inner wall at first deepens and is then bounded by projection 67 that extends the width of grip part 3. Elongated groove 68 is spaced a short distance from the extreme left-hand edge of grip part 3 and is positioned in the middle of grip part 3. Smaller groove 69 is spaced a short distance from the extreme left-hand edge of grip part 3 and depends from the upper interior wall of grip part 3. For the support of sleeve 25, pipe 33 is provided with groove 70.

Figure 6:
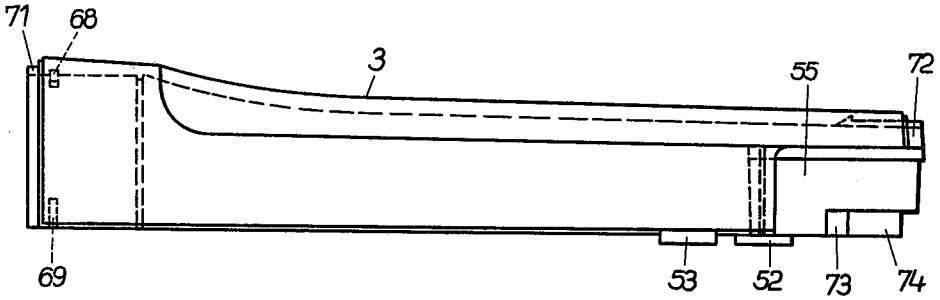
FIG. 6 shows the first semi-cylindrical grip parts according to FIG. 5 but rotated 90 degrees.

FIG. 6 illustrates grip part 3 rotated about its longitudinal axis by 90°. Pipe 33 is therefore not visible because it projects downwardly. For inserting suction grid 4 into position, recess 71 is provided at the left-hand end of grip part 3. Grooves 68 and 69 are indicated by broken lines. The right-hand end of grip part 3 includes recess 72 which is linked to recess 55. Recess 55 is provided with inclined step 73 that deepens from the left to the right. Flatly shaped surface 74 is connected to step 73 and is recessed from the surface of recess 55. Protruding tongues 52 and 53 are seen to the left of step 73.

Figure 7:
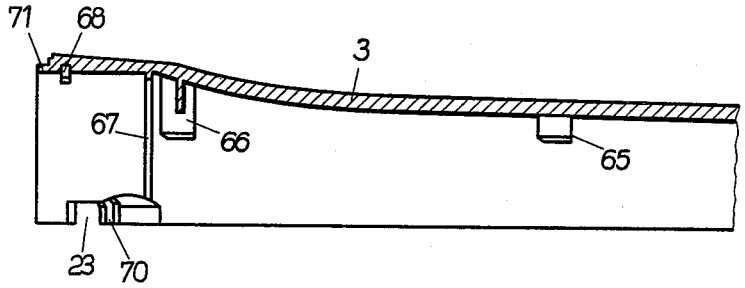
FIG. 7 shows a fragmentary section taken along the central axis of the grip part of FIG. 5.

FIG. 7 shows a section of grip part 3 illustrated in FIGS. 5 and 6 in such a way that the aperture 23 is viewed from the interior of grip part 3. Projections 65, 66 and 67 support conductor plate 34.

FIG. 8 is a plan view of the inner wall of the grip part 2. Grip part 2 has a construction similar to that of grip part 3. However, a few elements are constructed in a complimentary manner so that the grip parts 2 and 3 engage each other. The grooves 80, 81, 82 and 85 correspond respectively to the grooves 68, 69, 70 and 57. Projections 86 and 87 correspond respectively to the projections 65 and 66. The projections 83 and 84 engage grooves 50 and 51. Similarly, at places where grip part 3 is provided with tongues 52 and 53, grip part 2 includes complimentary grooves 88 and 89. The recess 90 at the left-hand end of grip part 3 differs from recess 60 of grip part 2 only in that protruding parts 59 and 64 are deleted and two additional projections 94 and 95 parallel to projections 92 and 93 are provided.

FIG. 9 shows the grip part 2 illustrated in FIG. 8 rotated about its longitudinal axis by 90°. Recess 96 for the push-mounting of suction grid 4 is positioned at the right-hand end of grip part 2. Grooves 80 and 81 are indicated by broken lines. The left-hand end of grip part 2 includes recess 97 adjacent to recess 55. Recess 55 includes step 98 which deepens from the right to the left. Flatly shaped surface 99 is connected to step 98 and is recessed from the surface of recess 55. Grooves 88 and 89 into which the tongues 52 and 53 of grip part 3 can be engaged are located to the right of step 98.

FIG. 10 shows a section through grip part 2 illustrated in FIGS. 8 and 9 in such a way that aperture 23 can be seen from the inside. Projections 86, 87 and 99; grooves 80 and 82; and recess 96 are also shown.

Figure 11:
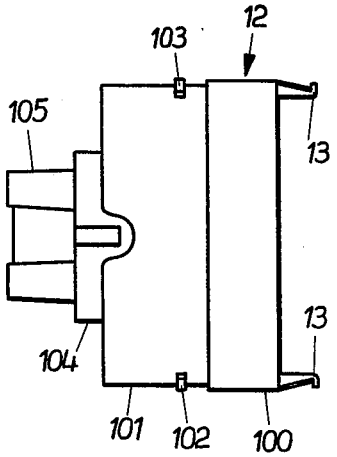
FIG. 11 is a side view of an air swirler forming part of the hair dryer.

FIG. 11 shows air swirler 12 from its side that includes barbs 13. These barbs 13 are disposed at and extend from rotary part 100 which fits resiliently into and is attached to another rotary part 101. Rotary part 101 has two rails 102 and 103 adapted to receive exhaust grid 5. Web 21 (FIG. 2) also provides for the securement of exhaust 5 but is not shown in FIG. 11. Adjacent to rotary part 101 is impeller body 104 which includes two supports 105 connected to one another.

Figure 12:
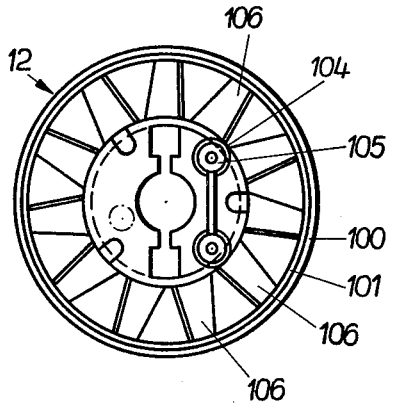
FIG. 12 is a rear view of the air swirler.

Air swirler 12 is shown in FIG. 12 viewed from its rear. Impeller blades 106 are clearly shown as being located between impeller body 104 and rotary part 101.

Figure 13:
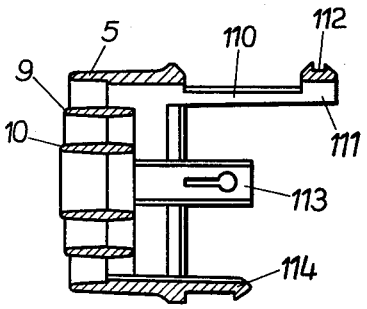
FIG. 13 is a side view in section of an exhaust grid forming part of the hair dryer.

FIG. 13 is partly a side view and partly a broken-away view of exhaust grid 5 which includes air passage ribs 9 and 10. Upper frame 110 includes rail 111 which has groove 112. In addition, barb 113 is shown in plan view and another barb 114 in side view.

Figure 14:
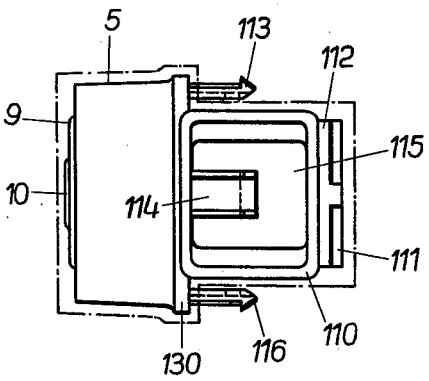
FIG. 14 shows the exhaust grid according to FIG. 13, rotated 90 degrees.

FIG. 14 illustrates again exhaust grid 5 rotated by 90° from FIG. 13. Frame 114 includes an approximately square aperture 115 to receive slider switch 6. In addition to barbs 113 and 114, another barb 116 is shown.

Figure 15:
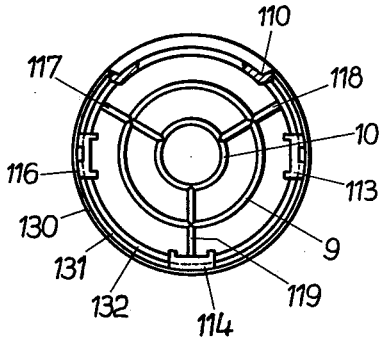
FIG. 15 shows the exhaust grid as viewed from the sides which is adapted to face the interior of the hair dryer.

FIG. 15 shows exhaust grid 5 as viewed from inside of grip parts 2 and 3. Frame 110, barbs, 113, 114, 116 and air passage ribs 9 and 10 are connected to one another via webs 117, 118 and 119. It can also be seen that the edge of exhaust grid 5 is constructed in such a way that it has three steps 130, 131 and 132 to receive and to encompass recesses 72 and 97.

The assembly of the hair dryer 1 is effected as follows. One of the two grip parts 2 or 3 is taken and conductor plate 34, wire-heater 32, connection unit 31, motor 18, air swirler 12, and impeller wheel 19 are fitted therein and secured in place. The securing is effected by means of the projections 65, 66, 86 and 87 and other means. Thereafter, sleeve 25 with its collar 26 is clamped into groove 70. The locking of air swirler 12 in the grip part is achieved by letting rails 102 and 103 engage into one of the corresponding grooves 68 and 80.

After having arranged all interior components in one of the grip parts, the second grip part is engaged with the first grip part. This engagement is effected by engaging the projections 83 and 84 into the grooves 50 and 51 and projections 52 and 53 into the grooves 88 and 89.

In this condition the grip parts 2 and 3 can be still separated from each other without difficulty. In order to fasten grip parts 2 and 3 rigidly together, exhaust grid 5 is pushed onto the assembled grip parts with care being taken so that during this operation slider switch 6 remains in its middle position. Lateral barbs 113 and 116 glide respectively along the recesses 90 and 60. Barb 114 glides along the deepening or notch which is formed by recesses 120 and 121 of grip parts 2 and 3.

Frame 110 of exhaust grid 5 glides on its edges in grooves 56 along recess 55. Since the edges are wedge-shaped and the groove is slotted, a positive gliding movement is achieved. As frame 110 is pushed forward until the front of rail 111 approaches grooves 57 and 85. There is a collar just in front of these grooves 57 and 85 and rail 111 includes groove 112. This collar snaps into groove 112 thereby locking frame 110 to the grip parts 2 and 3. Simultaneously, barbs 113, 116 and 114 also snap into recesses 90, 60, 120 and 121, thus securing exhaust grid 5 and the grip parts 2 and 3 in position.

After firmly locking one side of hair dryer 1 by use of exhaust grid 5, the other side has to be locked. Swirler 12 has already been inserted into the other side. Rotary part 100 of air swirler unit 12 to which barbs 13 are attached protrudes from grip parts 2 and 3. Suction grid 4 is pushed over rotary part 100 in such a way that barbs 13 extend toward a notch on the inner wall of suction grid 4 (see FIG. 1, right-hand section). When barbs 13 reach this notch they snap into it, thus locking suction grid 4 on the grip parts 2 and 3. Since the grip parts 2 and 3 have recesses 71 and 96 over which the front part of suction grid 4 is pushed, both grip parts 2 and 3 also become rigidly connected to one another. In this way hair dryer 1 is assembled without the use of screws or the like.

With this method of assembly considerable cost savings are achieved. In addition, the assembled hair dryer has very favorable properties regarding air flow, because there are no obstructions, such as dome-like protrusions for accommodating screw-connections. A further advantage is that the operating switch is placed close to the exhaust aperture.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A portable hair dryer comprising:

a first generally semi-cylindrical grip member, said first grip member having a pair of longitudinal contoured edge portions, said first grip member further having a recessed lip portion at least at a first end thereof and at least a first interior locking surface adjacent a second end thereof;

a second generally semi-cylindrical grip member, said second grip member having a pair of longitudinal contoured edge portions, said contoured edge portions of said first and second grip members being of complimentary shape whereby said grip members may be engaged with one another by said edge portions to define a tubular housing having a substantially regular outer surface, said housing further having openings at oppositely disposed ends thereof, said second grip member also having a recessed lip portion at least at the first end thereof and at least a first interior locking surface adjacent the second end thereof;

heater means mounted within the housing defined by said grip members;

blower means mounted within the housing defined by said grip members, said blower means including a tubular air intake passage defining member, said intake passage defining member extending outwardly through the first end opening of said housing, said intake passage defining member having a locking surface thereon;

tubular air intake grid means, said intake grid means having an inner diameter greater than the outer diameter of said blower means passage defining member and an outer diameter equal to the outer diameter of an adjacent end portion of said housing, said intake grid means fitting over the outwardly extending part of said blower means passage defining member and said grip member lip portions whereby said intake grid means forms a first extension of said regularly shaped housing, said intake grid means having a locking surface thereon complimentary in shape to the locking surface on said blower means passage defining member whereby said blower means and intake grid means are non-releasably locked together by engagement of said complimentary locking surfaces and said grip members are secured together by the capture of the lip portions thereof within said intake grid means;

tubular exhaust grid means, said exhaust grid means having a first portion which defines a second extension of said housing, said exhaust grid means further including a plurality of resilient locking projections extending outwardly therefrom into the second end opening of said housing, said locking projections engaging said locking surfaces on the interior of said first and second grip members to thereby non-releasably connect said exhaust grid means to said grip members and simultaneously hold said grip member edge portions in the engaged condition; and control switch means, said control switch means being mounted within said housing adjacent the second end opening thereof and including a movable actuator extending outwardly through an aperture in said housing to a point not exceeding the outer diameter of said housing in regions adjacent said aperture.

2. The apparatus of claim 1 wherein said blower means passage defining member locking surface includes at least one projection and the interior wall of said intake grid means includes at least one recess, said projection being engaged in said recess to provide a non-releasable locking arrangement.

3. The apparatus of claim 2 wherein said blower means passage defining member further includes at least one protrusion and the interior wall of said housing includes a recess for receiving said protrusion, said protrusion being engaged in said recess to secure said blower means within said housing.

4. The apparatus of claim 1 wherein said grip member contoured edge portions comprise complimentary longitudinally extending grooves and projections.

5. The apparatus of claim 3 wherein said grip member contoured edge portions comprise complimentary longitudinally extending grooves and projections.

6. The apparatus of claim 1 wherein the aperture in said housing for receiving said control switch is defined by cut-outs in said grip members extending inwardly from the second end thereof.

7. The apparatus of claim 6 wherein said exhaust grid means further comprises a supporting projection for said control switch means.

8. The apparatus of claim 3 wherein the aperture in said housing for receiving said control switch is defined by cut-outs in said grip members extending inwardly from the second end thereof.

9. The apparatus of claim 5 wherein the aperture in said housing for receiving said control switch is defined by cut-outs in said grip members extending inwardly from the second end thereof.

10. The apparatus of claim 9 wherein said exhaust grid means further comprises a supporting projection for said control switch means.

* * * * *